United States Patent [19]

Brunton

[11] 4,236,657

[45] Dec. 2, 1980

[54] BACKPACK

[76] Inventor: Ronald G. Brunton, Flat 15, 71 Ryde Rd., Hunters Hill, Australia, 2110

[21] Appl. No.: 16,602

[22] Filed: Feb. 21, 1979

[30] Foreign Application Priority Data

Feb. 28, 1979 [AU] Australia ..... PD3545

[51] Int. Cl.[3] ..... A45F 3/04; A45F 4/02

[52] U.S. Cl. ..... 224/153; 190/52; 224/209; 224/237

[58] Field of Search ..... 224/153, 202, 209–216, 224/235, 237, 259; 190/43, 52

[56] References Cited

U.S. PATENT DOCUMENTS

| | | | |
|---|---|---|---|
| Re. 25,826 | 8/1965 | Ward | 190/52 |
| 417,301 | 12/1889 | Weldon | 224/214 X |
| 1,491,807 | 4/1924 | McLinn | 190/52 |
| 2,180,191 | 11/1939 | Bauch | 190/52 |
| 2,428,795 | 10/1947 | Frazee | 224/153 |
| 3,933,229 | 1/1976 | Pelavin | 190/52 |

*Primary Examiner*—Stephen Marcus

*Attorney, Agent, or Firm*—Kane, Dalsimer, Kane, Sullivan and Kurucz

[57] ABSTRACT

A back pack with shoulder straps has a flap along one rear side edge thereof and a pair of leaves are hingedly connected by a zip to said flap; the leaves form an envelope which opens out at right angle to the zip when the leaves are arranged in a packing position, enabling clothes to be received neatly into said envelope whereupon the leaves are wrapped around one another and the pack in a stouted position and secured; the envelope is detachable from the pack and has a handle to permit use as a release.

13 Claims, 7 Drawing Figures

BACKPACK

BACKGROUND OF THE INVENTION

This invention concerns traveller's pack. If a traveller wishes to use a known type of backpack, that is with an external frame and a separate bag, then several disadvantages are at once apparent. Firstly clothes put into the bag have their appearance spoiled by creases. Secondly items are difficult to retrieve unless the whole contents of the bag are unpacked. Thirdly, no check upon what has already been packed can easily be made once packing has begun unless the process is reversed.

SUMMARY OF THE INVENTION

This invention provides a traveller's pack comprising a multi-sided backpack having a rear face for contacting the wearer's back and shoulder straps secured to said face, said face having a pair of mutually opposite sides and a leaf having a fixed end and a free end, said fixed end being connected to one of said sides, said leaf being arrangeable in both a packing position in which it lies extended for supporting articles to be packed or unpacked and the stowed position in which it is wrapped around the backpack and is secured in that position to the backpack.

This invention also provides a traveller's pack comprising a backpack having a face for contacting the wearer's back and shoulder straps secured to the said face, said pack having a pair of mutually, opposite sides, first leaf connected to one of said sides, a second leaf connected to the mutually opposite side, both of said leaves being arrangeable in both a packing position in which they lie extended for supporting articles to be packed or unpacked and a stowed position in which they are wrapped around the backpack and each other and secured in that position to the backpack.

This invention further provides a traveller's pack comprising a backpack having a face for contacting the wearer's back and shoulder straps secured to said face, said pack having at least one straight side and an elongate leaf which leaf has a substantially central minor axis such that the leaf consists of two super-imposable halves, said leaf being connected along said minor axis to said straight side of the pack, each of the halves of the leaf being arrangeable in both a packing position in which they lie extended for supporting articles to be packed or unpacked and a stowed position in which they are wrapped around the backpack and each other and are secured in that position to the backpack.

There may be two leaves connected to the left and right hand side of the panel respectively, both of which are releasably securable to their respective opposite sides of the panel. But preferably there are two leaves connected to a common side of the pack and said leaves form one face of an envelope, the other face being formed by two flaps which are closable and securable to imprison within the envelope, items of clothing laid flat therein. Such envelope may be disconnectable from the pack and may be foldable along an axis perpendicular to the boundary of the conjoined flaps and there may be a carrying handle on the disconnectable face of the envelope which permits the envelope to be carried as a valise. The envelope may have a stiffening member at one end edge and a ring for suspending the envelope vertically as a clothes-tidy when the envelope is disconnected from the pack. The envelope may be connected to the pack by a zip of which one half of the stringers project from the disconnectable face of the envelope while the other project from the first flap connected to the rear side edge of the backpack and there is a second flap connected to the front side edge of the pack with a spare zip stringer projecting therefrom, said first and second flaps being of such a width as will permit the pairing of the stringers on the flaps when the envelope is disconnected from the pack. The shoulder straps of the panel or pack may be stowable behind flaps which project from that face of the panel or pack which contact the wearers back and said flaps may be secured to the said face by hook and pile fasteners. The leaf which in the stowed position lies outmost may support a removable satchel.

Various embodiments of the invention will now be described by our example with reference to the drawings in which

DETAILED DESCRIPTION OF THE INVENTION

Figure 1:
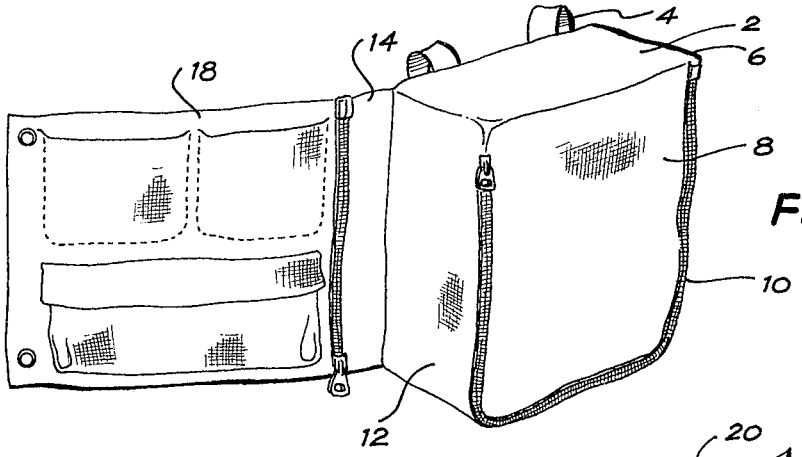
FIG. 1 is a front perspective view of a backpack with a leaf shown in the packing position.

Referring firstly to FIG. 1 the pack comprises a bag 2 made of cotton duck fabric. The rear face of the bag 2 has two shoulder straps 4. The right side 6 of the bag has two central rows of press-studs (not shown). The front face 8 of the bag is closed by a zip 10. On the left side 12 of the bag is a flap 14. A leaf 18 is attached by a zip to the flap 14.

Figure 6:
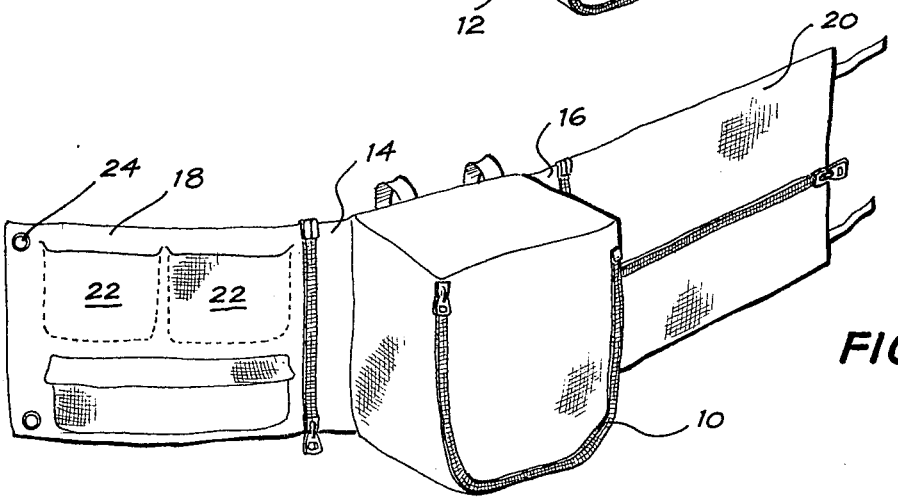
FIG. 6 is a front perspective view of a backpack with two leaves in the packing position.

Referring now to FIG. 6, the construction is the same with the addition of a right hand leaf 20, attached to a right hand flap 16. The left hand leaf has two horizontal pockets 22 for flat items to be packed, for example a change of clothes. The leaf 18 has press-studs 24 for engaging complementary press-studs (not shown) on the right hand side of the bag. The right hand leaf 20 is constructed as an envelope with a central horizontal zip 26 which permits access to the interior thereof.

Figure 7:
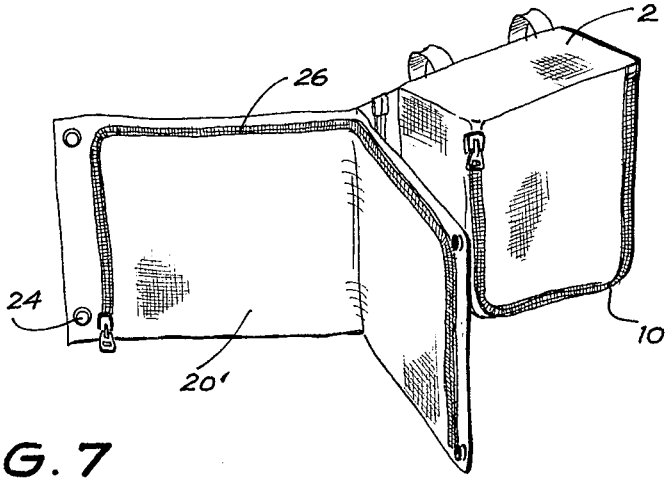
FIG. 7 is a front perspective view of a pack with a zip-closed envelope similar to that shown in FIG. 3.

In FIG. 7, the leaf 18 is not present and instead an envelope 20' is attached along the central minor axis thereof so as to form a bifurcated structure capable of wrapping in two layers over the surface of the bag 2. Press studs 24 on the envelope 20' engage complementary studs on the hidden side of the bag.

Referring again to FIG. 6, in use the pack is laid on the ground with the leaves extended. The bag 10, the pockets 22 and the envelope 20 are filled and then the left hand leaf 18 is wrapped around the bag and attached to it by press-studs 24 after which the right hand leaf 20 is also wrapped around the bag and secured to the left hand leaf by press-studs 32.

Figure 2:
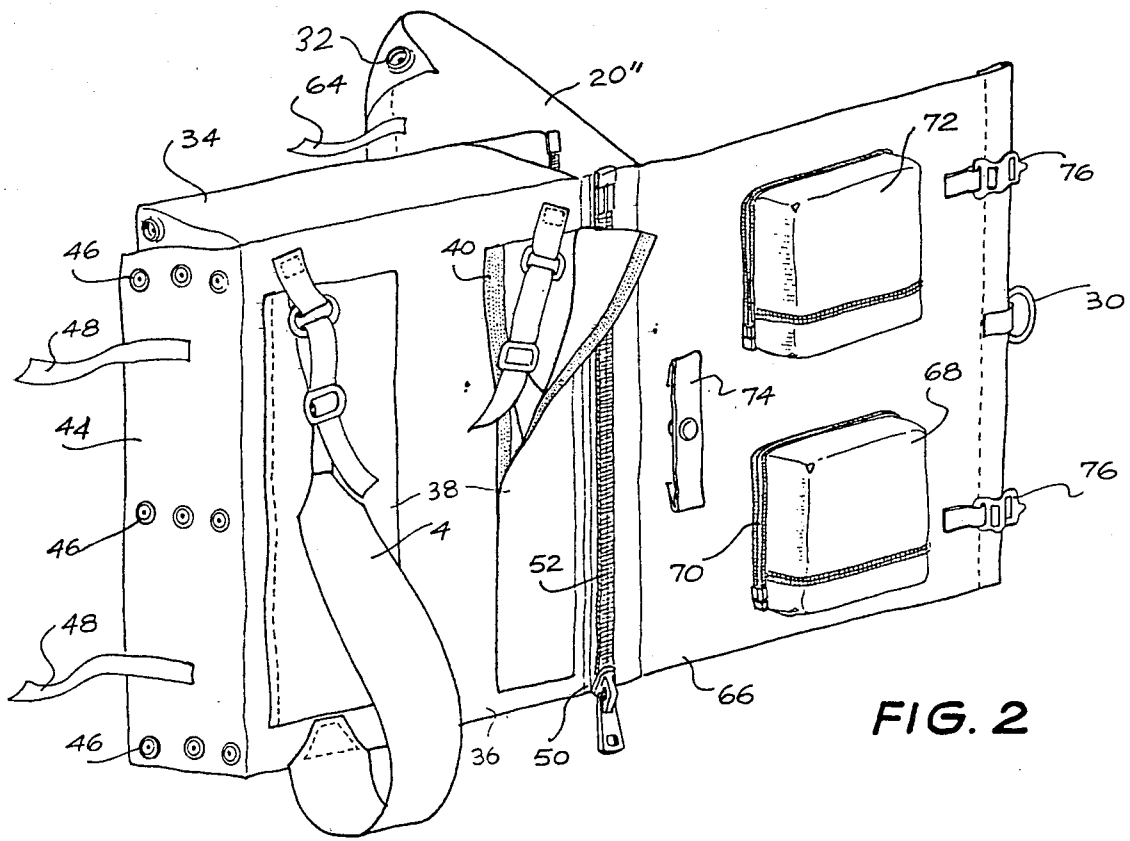
FIG. 2 is a rear perspective view of a further embodiment of a backpack with the leaves in the packing position.
Figure 3:
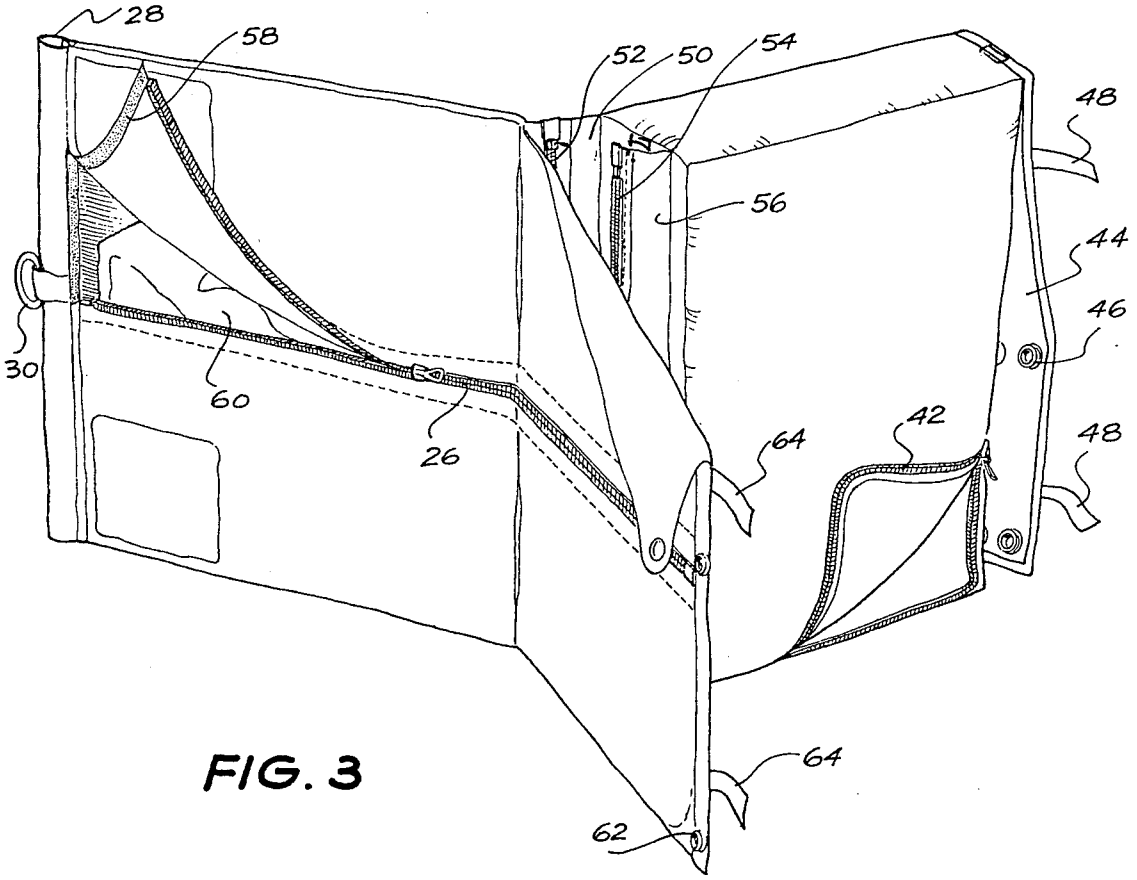
FIG. 3 is a front perspective view of a backpack shown in FIG. 2.

Referring now to FIGS. 2 and 3, the panel 6 and integral frame is replaced by a frameless backpack 34 made of cotton duck. Shoulder straps 4 are sewn to the rear face 36 of the backpack and there are flaps 38 behind which the straps 4 may be neatly stowed. Hook and pile strips 40 close the flaps 38.

The front of the pack is closed by a zip fastener 42. The rear face of the pack 36 has an extending flap 44 to which three rows of three press-studs 46 are attached as well as two straps 48. The opposite side of the pack also has an extending flap 50 to which is sewn half the stringers of a zip fastener 52. A spare row of stringers 54 the purpose of which will be described later, is sewn to a flap 56. The mating row of stringers of the zip fasteners 52 is sewn to an off-centre minor axis of an envelope 20" which is fastened by a longitudinally disposed zip 26 and hook and pile strips 58.

Envelope 20" is large enough to accomodate a jacket 60 and trousers (not shown) which are arranged on a clothes hanger in a flat condition within the envelope 20". One end of the envelope is stiffened by an aluminium strut (not shown) housed in a seam pocket 28 and the envelope is suspendable by a ring 30 as a clothes tidy when the envelope is detached from the bag. A further ring (not shown) serves to suspend a coat hanger inside the envelope. The opposite end of the envelope is provided with press-studs 62 and straps 64.

The front face 66 of the envelope carries a lower satchel 68 secured by a U-shaped zip fastener 70. The upper satchel 72 is likewise secured and has a shoulder strap (not shown) tucked into the U-shaped cavity. There is a carrying handle 74 on the central minor axis of the envelope and buckles 76 are located at the stiffened end thereof.

In the construction shown in FIG. 7 the envelope 20' is made of two rectangular superimposed sheets of fabric sewn together and provided with a zip 26 along three sides thereof.

Figure 5:
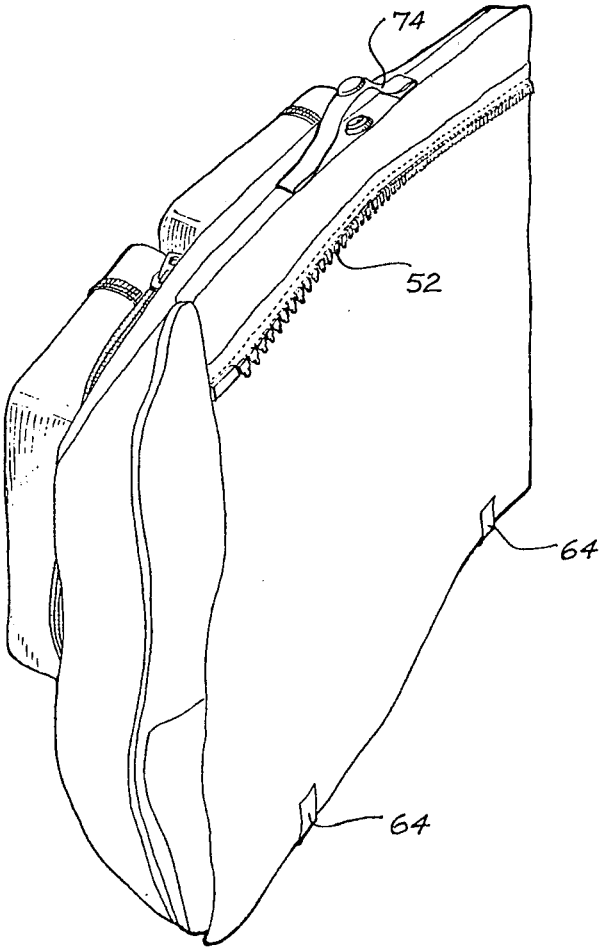
FIG. 5 is a perspective view of part of the backpack detached as a valise.

The manner of use is as follows:

The pack is firstly divisible into two halves by unfastening the zip 52 and engaging the unused zip stringer of fastener 52 with the spare stringer 54 on flap 56. The flap 44 is secured to the side of the pack by the press-studs thereon. The backpack may be filled and worn separately. The envelope may be filled with clothes and the buckles 76 engaged by the straps 64 to permit the envelope to be carried by the handle 74 as a valise, as shown in FIG. 5.

Figure 4:
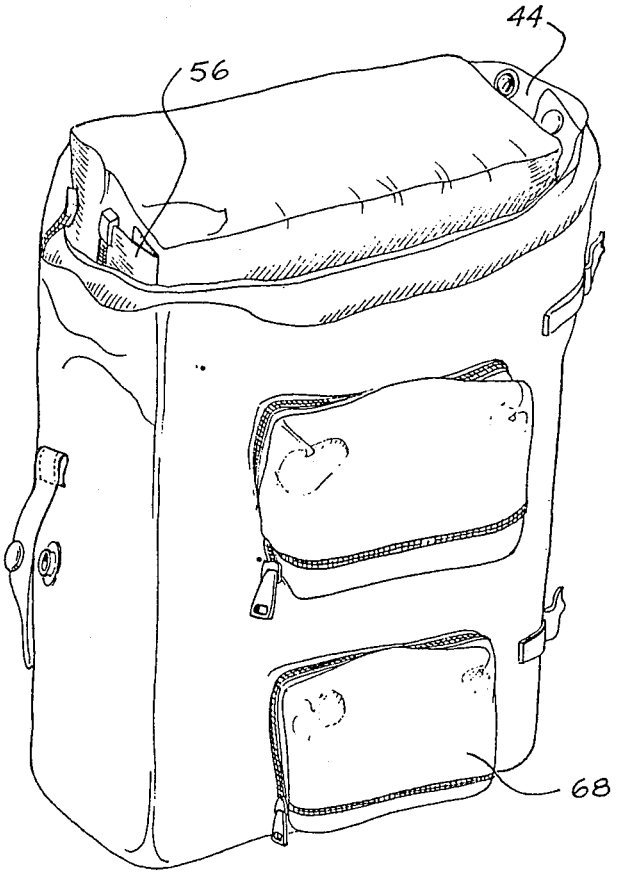
FIG. 4 is a front perspective view of a backpack of FIGS. 2 and 3 with the leaves in the stowed position.

Secondly, the zipping operation described above may be reversed and then the pack and envelope may be joined together by closing the zip fastener 52 whereafter one leaf of the envelope is wrapped compactly around the pack and secured by engagement of the press-studs 62 and 46. The remaining leaf hinges around the same axis as the first leaf and is superimposed and held by the straps 48 passing through buckles 76 as shown in FIG. 4.

The advantages of the first embodiment are simplicity of construction coupled with accessibility of the space afforded by the pack.

The advantages of the second embodiment are versatility arising from the capability of varying the volume of carrying space at ones disposal, the division into a valise and a backpack and the portability of clothes in a relatively crease-free condition.

The claims defining the invention are as follows:

1. A traveller's pack comprising a backpack having a face for contacting the wearer's back and shoulder straps secured to said face, said pack having at least one straight side and an elongate leaf which leaf has a substantially central minor axis such that the leaf includes two superimposable halves, said leaf being connected along said minor axis to said straight side of the pack, each of the halves of the leaf being arrangeable in both a packing position in which they lie extended for supporting articles to be packed or unpacked and a stowed position in which they are wrapped around the back pack and each other and are secured in that position to the back pack.

2. A traveller's pack as claimed in claim 1 wherein the two halves of the leaf form one face of an envelope, the other face being formed by two flaps which are closable and securable to imprison within the envelope, items of clothing laid flat therein.

3. A traveller's pack as claimed in claim 2 wherein the envelope is disconnectable from the pack and is foldable along said minor axis and there is a carrying handle on the envelope which permits the latter to be carried as a valise.

4. A traveller's pack as claimed in claim 3 wherein said pack has a rear face, a rear flap extending from said rear face along said straight side and a front flap extending from said front face along said straight side and the envelope has a face which is connectable along said minor axis to the pack by a zip of which one half of the stringers project from said rear flap and the remaining half of the stringers project from said one envelope face while the front flap has a spare set of stringers as projecting therefrom, said front and rear flaps being of such width as permits a pairing of the stringers on the flaps when the envelope is disconnected from the pack.

5. A traveller's pack claimed in claim 2 wherein the envelope has an end edge and a stiffening member at said edge and an eye connected to said member for suspending the envelope vertically as a clothes tidy when the envelope is disconnected from the pack.

6. A traveller's pack as claimed in claim 2 wherein the half of the leaf which is in the stowed position lies outermost, supports a removable satchel.

7. A traveller's pack as claimed in claim 1 wherein the two halves of the leaf form one face of an envelope, the other face being formed by a superimposed sheet of fabric which is connected edge to edge with the leaves by a releasable fastener.

8. A traveller's pack comprising a backpack having a face for contacting the wearer's back and shoulder straps secured to said face; said pack having a pair of mutually opposite sides; a substantially rectangular envelope connected to one of said sides along an off-center minor axis thereof, said envelope being arrangeable in a packing position in which a first portion of said envelope on one side of said axis and a second portion of said envelope on the other side of said axis lie extended, and a stowed position in which said portions are wrapped around the backpack and each other.

9. A traveller's pack as claimed in claim 8 wherein said one of said sides of said backpack includes an extending flap to which is sewn half the stringers of a zip fastener, a mating row of stringers is sewn to the off-center minor axis of said envelope, said envelope being connected to said backpack by means of said stringers.

10. A traveller's pack as claimed in claim 9 wherein said one of said sides of said backpack includes a second flap having half the stringers of a zip fastener projecting therefrom, said flaps being of such width as to permit pairing of their respective stringers when the envelope is disconnected from the pack.

11. A traveller's pack as claimed in claim 8 wherein said envelope includes one face formed by a leaf and an opposite face formed by two flaps which are closable and securable.

12. A traveller's pack as claimed in claim 8 wherein said envelope includes a carrying handle.

13. A traveller's pack as claimed in claim 8 wherein the envelope has an end edge, a stiffening member at said edge, and a ring connected to said member.

* * * * *